US006268027B1

(12) United States Patent
Wu

(10) Patent No.: US 6,268,027 B1
(45) Date of Patent: Jul. 31, 2001

(54) ORNAMENT FOR PLACEMENT

(76) Inventor: Li-Hsiung Wu, No. 28, Lane 171, San Min Road, Lu Zhou city, Taipei Hsien (TW)

( * ) Notice: Subject to any disclaimer, the term of this patent is extended or adjusted under 35 U.S.C. 154(b) by 0 days.

(21) Appl. No.: 09/714,159

(22) Filed: Nov. 17, 2000

(30) Foreign Application Priority Data

Jul. 6, 2000 (TW) ..... 89211640

(51) Int. Cl.[7] ..... A47G 1/12

(52) U.S. Cl. ..... 428/13; 428/14; 428/34.1; 428/542.2; 446/267; 40/406; 40/407

(58) Field of Search ..... 428/13, 14, 15, 428/34.1, 542.2; 40/406, 407; 446/267

(56) References Cited

U.S. PATENT DOCUMENTS 5,292,564 * 3/1994 Lee ..... 428/13
5,378,513 * 1/1995 Lee ..... 428/13
5,476,406 * 12/1995 Cheng ..... 446/267
5,503,274 * 4/1996 Toffler et al. ..... 206/457
5,985,379 * 11/1999 Longsdorf et al. ..... 428/13
5,989,655 * 11/1999 Meng ..... 428/13
6,001,433 * 12/1999 Meng ..... 428/13
6,117,502 * 9/2000 Liao ..... 428/13

* cited by examiner

*Primary Examiner*—Deborah Jones
*Assistant Examiner*—Abraham Bahta
(74) *Attorney, Agent, or Firm*—Dougherty & Troxell

(57) ABSTRACT

An improved ornament for placement includes an elastic plastic cover which is a tubular member formed from high molecular polymer material having elasticity, one end thereof being a closed end, the other end thereof being an open end, the periphery of the open end extending laterally to form an engaging ring having a substantially L-shaped cross-section; a connecting ring which is a hollow annular fixed member and has a top portion provided downwardly with a projecting ring of a substantially inverted-J cross-section at a position corresponding to the engaging ring, a lower end of the projecting ring being integrally provided with a connecting portion; an annular base which is a multi-step annular member provided respectively with an annular post and a pivotal portion at an upper end at positions corresponding to the open end and the connecting portion. The engaging ring is inserted into the projecting ring to achieve tight connection. A fluid and/or a floating ornamental object are disposed in the plastic cover via the open end. The annular base is fitted into the open end such that the annular post thereof and the projecting ring cooperatively clamp the connecting ring. The pivotal portion is coupled with the connecting portion such that an annular platform at an upper end of the pivotal portion abuts against a bottom edge of the engaging ring to achieve sealing.

12 Claims, 5 Drawing Sheets

ORNAMENT FOR PLACEMENT

BACKGROUND OF THE INVENTION

1. Field of the Invention

The invention relates to an improved ornament for placement, more particularly to an ornament including a plastic cover filled with a fluid and/or a floating ornamental object The plastic cover can be squeezed to permit contact with the floating ornamental object, without breaking the plastic cover or leakage of the fluid.

2. Description of Related Art

A conventional ornament containing a floating ornamental object in a liquid for viewing purposes basically includes a rigid transparent cover in which are disposed a liquid and a floating ornamental object, and a base connected to the cover such that the liquid will not leak. Since the cover and the base are both made of rigid material, the shape and appearance thereof are fixed and restricted. Besides, the ornament can only be used for viewing, and the ornamental object disposed therein cannot be touched.

Referring to FIG. 1, a conventional ornament for placement disclosed in R.O.C. Patent Application No. 87212194 is shown. The ornament as shown includes a hollow tabular soft transparent plastic film A. The opening at one end of the plastic film A passes through a base hold B1 in a bottom coupling base B. A tightening band C1 is used to tighten the opening. Then the other end of the plastic film A is folded reversely to wrap the coupling base B within the plastic film A. Next, a base coupling portion D1 at the top of a bottom cover D is joined to an annular portion B2 of the bottom portion of the coupling base B such that the coupling base b and bottom cover D together envelop and clamp the plastic film A. The opening at the other end of the plastic film A is pre-filled with a fluid G and a floating ornamental article H. After fitting a coupling cover E therein, a band C2 is used to tighten said opening. A coupling portion F1 of the bottom portion of a top coupling seat F is joined to an annular portion E2 of the top portion of the coupling cover E such that the band C2 is received therebetween, and the plastic A is sandwiched between the coupling cover E and the top coupling seat F. When the user squeezes the plastic film A, he can touch the floating ornamental object therein. At the same time, the plastic film A will deform when squeezed to thereby provide a temporary change in shape.

The drawback with the above-described ornament is that since the opening at one end of the plastic film A and the band C1 are disposed inside the plastic film A, they mar the aesthetic appearance of the ornament. In addition, after tightening of the opening at the other end of the plastic film A with the band C2, the tightening effect is not satisfactory. Therefore, there is the problem of leakage. To overcome said problem, in practice, a sealing agent is applied to the two openings at the bands. Although this can prevent occurrence of leakage, the manufacturing process is complicated. Furthermore, the coupling base B and the top coupling seat F have to be respectively disposed in the plastic film A, which increases the difficulty in assembly. Therefore, the use of bands C1, C2 is not a good means to prevent leakage of liquid.

SUMMARY OF THE INVENTION

The main object of the present invention is to provide an ornament for placement, which offers a better sealing and reducing the number of elements than the prior art.

According to the preferred embodiment of the present invention, the ornament for placement comprising an elastic plastic cover which is a tubular member formed from high molecular polymer material having elasticity, one end thereof being a closed end, the other end thereof being an open end, the periphery of said open end extending laterally to form an engaging ring having a substantially L-shaped cross-section; a connecting ring which is a hollow annular fixed member and has a top portion provided downwardly with a projecting ring of a substantially inverted-J cross-section at a position corresponding to said engaging ring, a lower end of said projecting ring being integrally provided with a connecting portion; an annular base which is a multi-step annular member provided respectively with an annular post and a pivotal portion at an upper end at positions corresponding to said open end and said connecting portion; whereby said engaging ring is inserted into said projecting ring to achieve tight connection, a fluid and/or a floating ornamental object being disposed in said plastic cover via said open end, said annular base being fitted into said open end such that said annular post thereof and said projecting ring cooperatively clamp said connecting ring, said pivotal portion being coupled with said connecting portion such that an annular platform at an upper end of said pivotal portion abuts against a bottom edge of said engaging ring to achieve sealing.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 2:
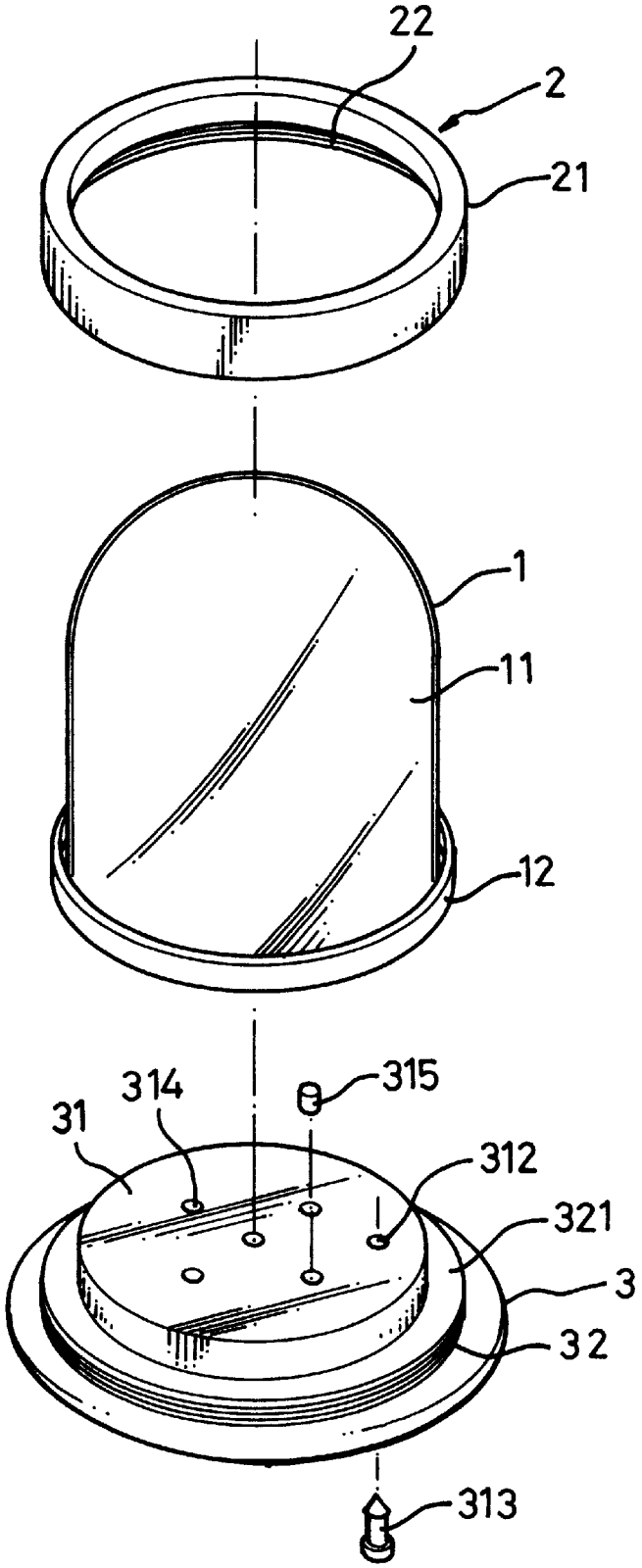
FIG. 2 is an exploded perspective view of the ornament for placement according to this invention.
Figure 3:
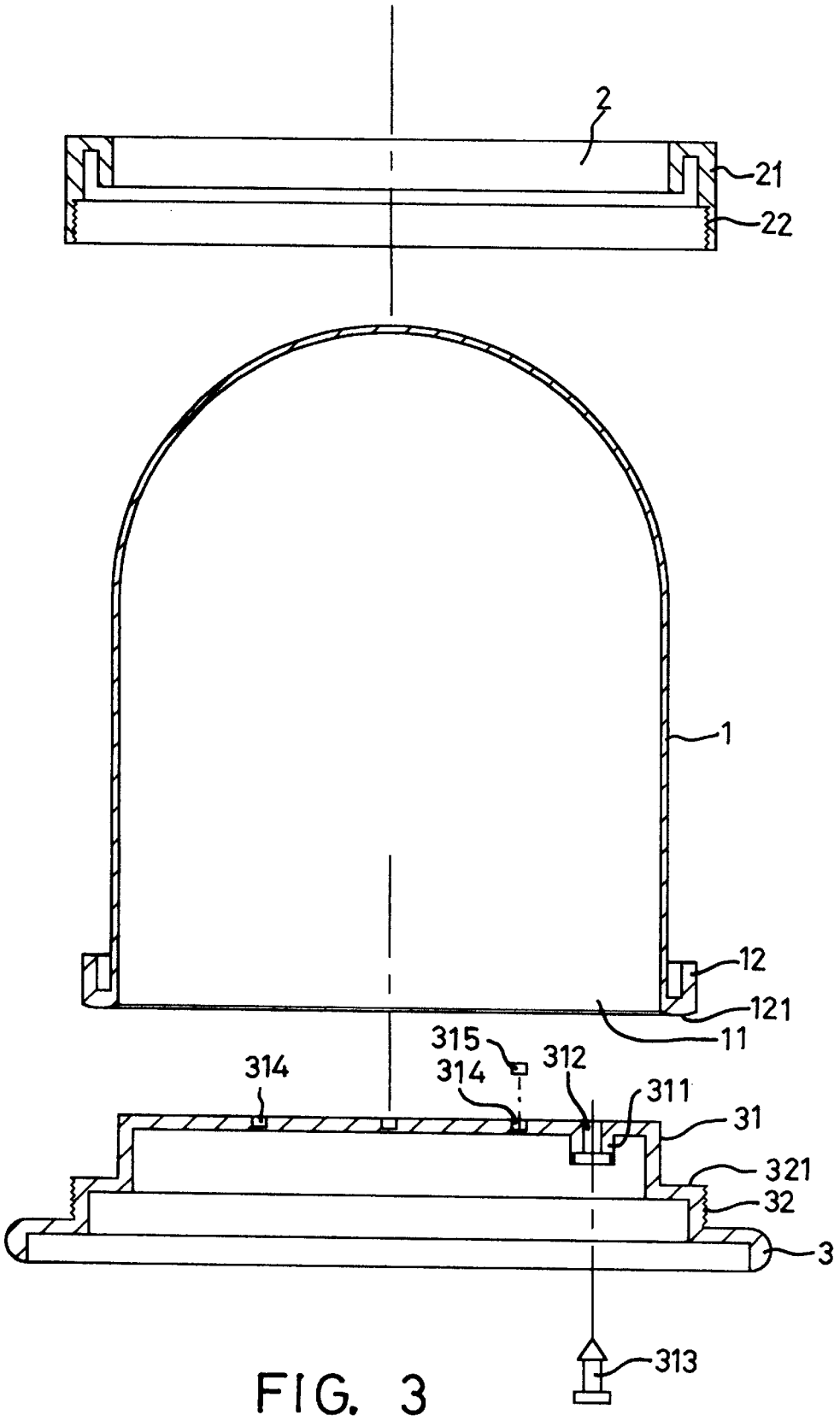
FIG. 3 is a sectional view of the elements shown in FIG. 2 prior to assembly.
Figure 4:
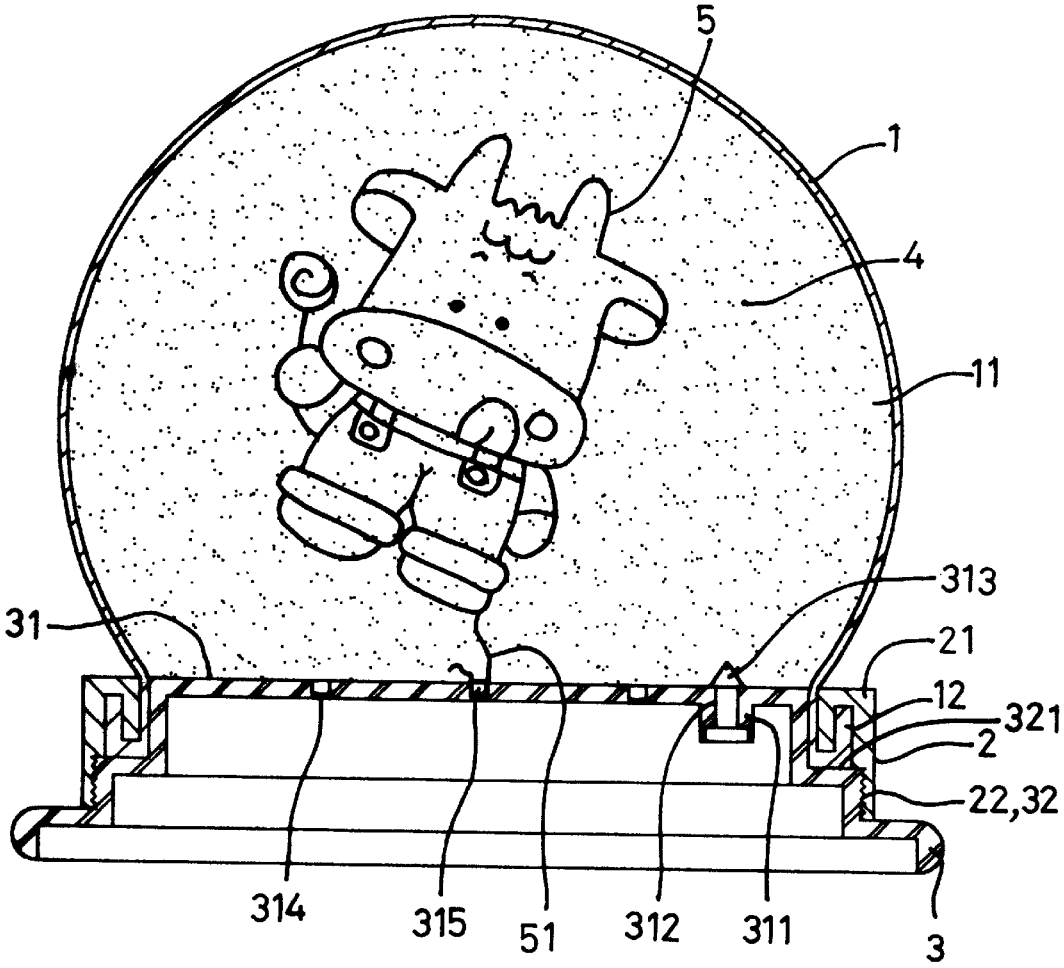
FIG. 4 is a sectional view of FIG. 2 after assembly.

With reference to FIGS. 2 to 4, the ornament for placement according to the invention basically includes an elastic plastic cover 1, a connecting ring 2, an annular base 3, and a fluid 4 and/or at least one floating ornamental object 5.

Figure 5:
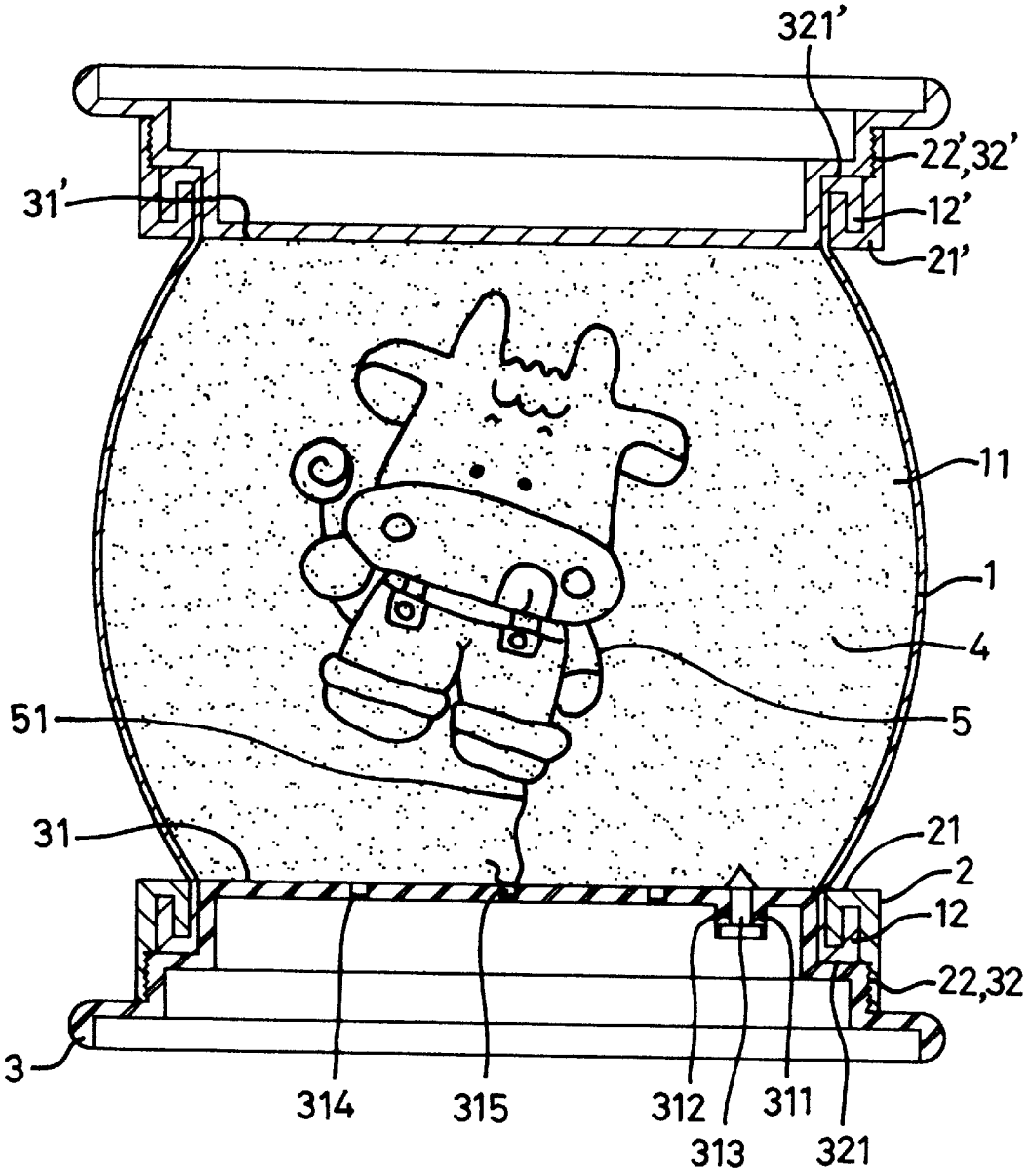
FIG. 5 is a sectional view of another preferred embodiment of this invention.

The plastic film 1 is a tubular structure formed from high molecular polymer material with elasticity. In practice, it can be an elastic plastic cover with a closed end, such as that shown in FIG. 2. Alternatively, as shown in FIG. 5, it can be an elastic plastic cover with two open ends. The periphery of an open end 11 of the plastic cover 1 extends laterally to form an engaging ring 12 having a substantially L-shaped cross-section so as to be coupled with the connecting ring 2. In addition, in order to enhance the sealing effect, the bottom edge of the engaging ring 12 is formed with a curved annular projection 121 such that when it contacts the annular base 3, it can be sufficiently squeezed to extend sidewise so as to achieve an enhanced sealing effect.

The connecting ring 2 is a hollow annular fixed structure having a top portion that is downwardly provided with a projecting ring 21 of a substantially inverted-J cross-section at a position corresponding to the engaging ring 12 such that after coupling of the connecting ring 2 and the engaging ring 12, as shown in FIG. 4. At this time, the open end 11 of the plastic cover 1 is in the form of a circle due to the support of the connecting ring 2. Then, the fluid 4 and/or floating ornamental object 5 are put inside the plastic cover 1 through the open end 11. In addition, the lower end of the projecting ring 21 is integrally connected to a connecting portion 22 to facilitate coupling with the annular base 3.

The annular base 3 is a multi-step annular structure. The upper end thereof is provided with an annular post 31 and a pivotal portion 32 at positions corresponding to the open end 11 and connecting ring 2 of the plastic cover 1 such that the annular post 31 and projecting ring 21 together clamp the engaging ring 12. The pivotal portion 32 can, in the process of coupling with the connecting portion 22, gradually compresses the annular projection 121 to cause it to tightly attach to an annular platform 321 at the upper end of the pivotal portion 32 to thereby prevent leakage.

Furthermore, in order that more of the fluid 4 can be filled into the plastic cover 1, the top face of the annular post 31 is downwardly provided with a projection 311 formed with an inverted T-shaped hole 312. An elastic arrow-shaped stopper 313 is inserted into the hole 312 to effectively stop leakage of fluid. Then, an injector can be used to pierce the stopper 313 to inject the fluid 4 into the plastic cover 1 so that the plastic cover 1 expands and swells.

The fluid 4 is a liquid or gel for filling the plastic cover 1. When the plastic cover 1 is squeezed or compressed, the fluid 4 can flow in the plastic cover 1 to enable the plastic cover 1 to produce temporary deformation. In addition, a floating ornamental object 5, such as a figurine, ornamental ball, tinsels, can be selectively disposed in the fluid to enhance the appearance of the ornament.

In addition, in order to enhance the floating effect of the floating ornamental object 5, a tie string 51 of the floating ornamental object 5 is received in a face hole 314 preformed in the top face of the annular post 31. A plug 315 can be inserted into the face hole 314 to secure the tie string 51 in place so that the floating ornamental object 5 in the fluid 4.

FIG. 5 shows another preferred embodiment of the invention. The difference between this embodiment and the embodiment shown in FIGS. 2 to 4 is that the plastic cover 1 has an open end 11 and a second open end 11'. During assembly, as described in the previous embodiment, a connecting ring 2 and an annular base 3 are coupled to the open end 11 at one side of the plastic cover 1. A second connecting ring 2' is coupled to the second open end 11'. The, a second projecting ring 21' is coupled to a second engaging ring 12. At this time, the fluid 4 and/or floating ornamental object 5 can be inserted into the plastic cover 1 via the second open end 11'. Finally, a second annular post 31' of a second annular base 3' is fitted tot he second open end 11', and a second pivotal portion 32' is coupled to a second connecting portion 22 to cause a second platform 321' thereof to abut against a second annular projection to achieve a sealing effect and thereby complete assembly of this embodiment.

Figure 1:
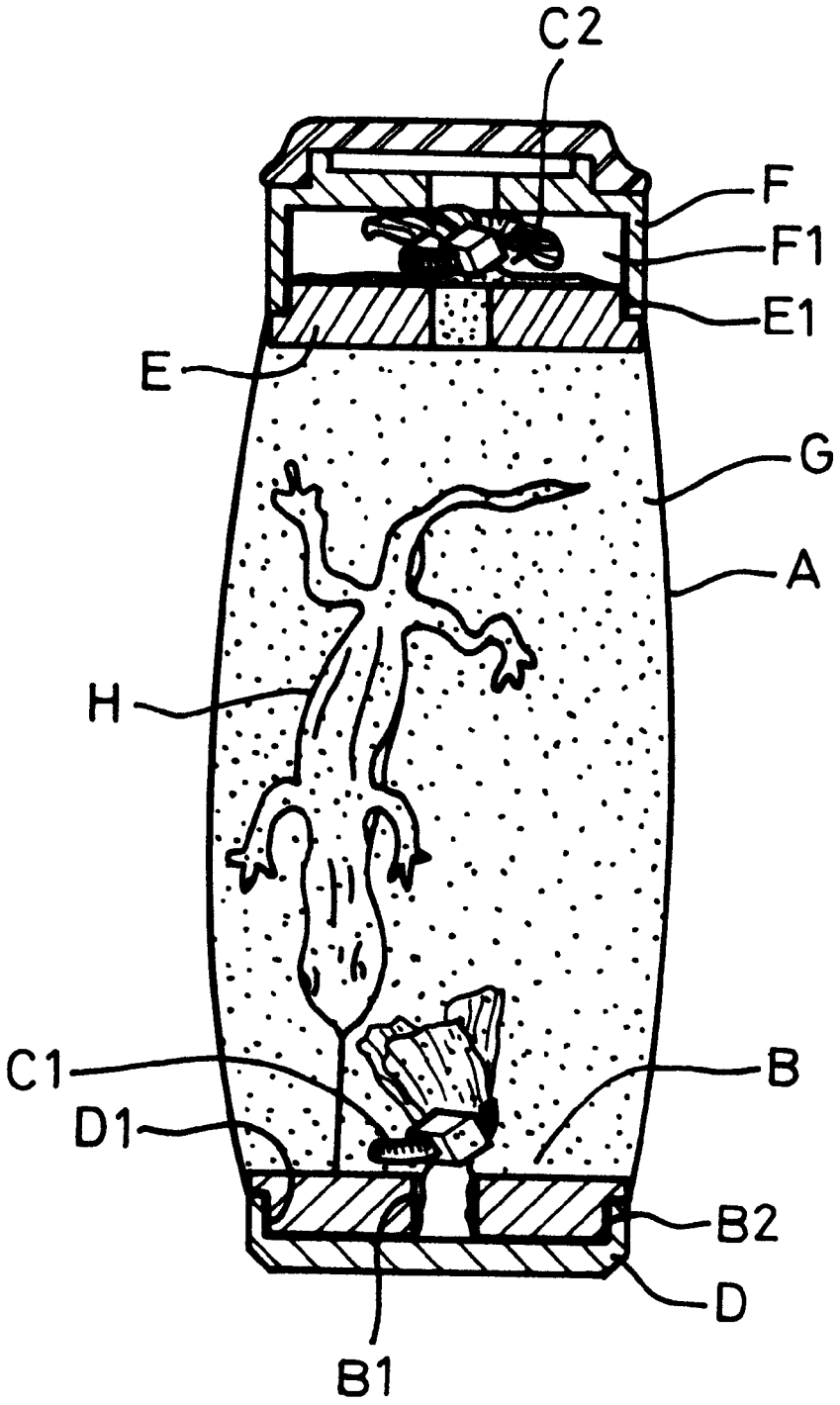
(PRIOR ART) FIG. 1
FIG. 1 is a sectional view of the prior art.

By virtue of this invention, the coupling between the engaging ring of the plastic cover and the projecting ring of the connecting ring is very simple, and can support the open end to make it form a circle. By utilizing the quick engagement between the pivotal portion of the annular base and the connecting portion of the projecting ring, such as threaded engaging or fastening, the annular platform at the upper end of the pivotal portion can abut against the annular projection of the bottom edge of the engaging ring. Besides, the annular post and the projecting ring cooperate to clamp the engaging ring to prevent leakage. Furthermore, by means of the hole and stopper or plug engagement, more fluid can be filled into the plastic cover to make it expand and swell. Compared with the prior art shown in FIG. 1, the present invention reduces the number of elements and saves manufacturing costs. In addition, assembly is simplified to save labor and assembly steps.

Although the present invention has been illustrated and described with reference to the preferred embodiments thereof, it should be understood that it is in no way limited to the details of such embodiments but is capable of numerous modifications within the scope of the appended claims.

What is claimed is:

1. An improved ornament for placement, comprising:

an elastic plastic cover which is a tubular member formed from high molecular polymer material having elasticity, one end thereof being a closed end, the other end thereof being an open end, the periphery of said open end extending laterally to form an engaging ring having a substantially L-shaped cross-section;

a connecting ring which is a hollow annular fixed member and has a top portion provided downwardly with a projecting ring of a substantially inverted-J cross-section at a position corresponding to said engaging ring, a lower end of said projecting ring being integrally provided with a connecting portion;

an annular base which is a multi-step annular member provided respectively with an annular post and a pivotal portion at an upper end at positions corresponding to said open end and said connecting portion;

whereby said engaging ring is inserted into said projecting ring to achieve tight connection, a fluid and/or a floating ornamental object being disposed in said plastic cover via said open end, said annular base being fitted into said open end such that said annular post thereof and said projecting ring cooperatively clamp said connecting ring, said pivotal portion being coupled with said connecting portion such that an annular platform at an upper end of said pivotal portion abuts against a bottom edge of said engaging ring to achieve sealing.

2. The improved ornament for placement of claim 1, wherein said bottom edge of said engaging ring is a curved annular projection for achieving enhanced sealing effect.

3. The improved ornament for placement of claim 1, wherein said fluid is a liquid or gel.

4. The improved ornament for placement of claim 1, wherein said connecting portion and pivotal portion are coupled via threaded engagement of fastening.

5. The improved ornament for placement of claim 1, wherein said annular post of said annular base is downwardly provided with a projection having an inverted T-shaped hole for receiving a stopper for positioning purposes, an injector passing through said stopper to further inject said fluid into said plastic cover.

6. The improved ornament for placement of claim 1, wherein top face of said annular post of said annular base is provided with a plurality of face holes, with tie string of a floating ornamental object disposed in one of said face holes, a plug being inserted into said face hole to secure said tie string.

7. The improved ornament for placement, comprising:

an elastic plastic cover which is a tubular member formed from high molecular polymer material having elasticity, each of two ends thereof forming an open end, the periphery of each open end extending laterally to form an engaging ring having a substantially L-shaped cross-section;

two connecting rings each of which is a hollow annular fixed member and has a top portion provided downwardly with a projecting ring of a substantially inverted-J cross-section at a position corresponding to said engaging ring, a lower end of said projecting ring being integrally provided with a connecting portion;

two annular bases each of which is a multi-step annular member provided respectively with an annular post and a pivotal portion at an upper end at positions corresponding to said open end and said connecting portions;

whereby one engaging ring is inserted into one projecting ring to achieve tight connection, one annular base being fitted into one open end of said elastic cover such that said annular post thereof and said projecting ring cooperatively clamp said connecting ring, said pivotal portion being coupled with said connecting portion such that an annular platform at an upper end of said pivotal portion abuts against a bottom edge of said engaging ring to achieve sealing at one end of said plastic cover, the other connecting ring being pre-connected to said elastic cover, said engaging ring thereof being inserted into the other projecting ring, a fluid and/or floating ornamental object being disposed into said elastic cover, the other annular base being fitted into the other open end of said plastic cover such that said annular post thereof and the other projecting ring cooperatively clamp the other engaging ring, while the other pivotal portion being coupled with the other connecting portion such that an annular platform at an upper end of said pivotal portion abuts against a bottom ring of the other engaging ring to achieve sealing at the other end of said plastic cover.

8. The improved ornament for placement of claim 7, said bottom edge of said two engaging rings is a curved annular projection for achieving enhanced sealing effect.

9. The improved ornament for placement of claim 7, wherein said fluid is a liquid or gel.

10. The improved ornament for placement of claim 7, wherein said connecting portion and pivotal portion are coupled via threaded engagement of fastening.

11. The improved ornament for placement of claim 7, wherein said annular post of one of said annular bases is downwardly provided with a projection having an inverted T-shaped hole for receiving a stopper for positioning purposes, an injector passing through said stopper to further inject said fluid into said plastic cover.

12. The improved ornament for placement of claim 7, wherein top face of said annular post of said annular base is provided with a plurality of face holes, with tie string of a floating ornamental object disposed in one of said face holes, a plug being inserted into said face hole to secure said tie string.

* * * * *